US010995455B2

(12) United States Patent
Bhat

(10) Patent No.: US 10,995,455 B2
(45) Date of Patent: May 4, 2021

(54) PAPER PRODUCT HAVING AN IMPROVED HANDFEEL

(71) Applicant: GPCP IP Holdings LLC, Atlanta, GA (US)

(72) Inventor: Dinesh M. Bhat, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 8 days.

(21) Appl. No.: 15/812,373

(22) Filed: Nov. 14, 2017

(65) Prior Publication Data

US 2018/0135254 A1 May 17, 2018

Related U.S. Application Data

(60) Provisional application No. 62/421,800, filed on Nov. 14, 2016.

(51) Int. Cl.

| | |
|---|---|
| ***D21H 27/02*** | (2006.01) |
| ***D21H 27/00*** | (2006.01) |
| ***B31F 1/07*** | (2006.01) |

(52) U.S. Cl.

CPC ..... *D21H 27/02* (2013.01); *B31F 1/07* (2013.01); *D21H 27/002* (2013.01); *B31F 2201/0733* (2013.01); *B31F 2201/0758* (2013.01); *B31F 2201/0784* (2013.01)

(58) Field of Classification Search

USPC ..... 162/117, 116, 109

See application file for complete search history.

(56) References Cited

U.S. PATENT DOCUMENTS

| | | | | |
|---|---|---|---|---|
| 3,953,638 | A | 4/1976 | Kemp | |
| 4,801,482 | A | 1/1989 | Goggans et al. | |
| D362,967 | S | 10/1995 | Rothwell et al. | |
| D367,766 | S | 3/1996 | Makoui et al. | |
| D392,108 | S | 3/1998 | Diggins et al. | |
| 6,033,761 | A * | 3/2000 | Dwiggins | B31F 1/07 162/109 |
| D428,264 | S | 7/2000 | Boyce | |
| 6,129,972 | A | 10/2000 | McNeil et al. | |
| 6,261,666 | B1 | 7/2001 | Enderby et al. | |
| 6,277,467 | B1 * | 8/2001 | Dwiggins | B31F 1/07 162/109 |
| D450,934 | S | 11/2001 | Duritsch et al. | |
| 6,368,454 | B1 | 4/2002 | Dwiggins et al. | |
| 7,527,851 | B2 * | 5/2009 | Schuh | D21H 25/005 428/156 |
| D632,896 | S | 2/2011 | Sanders et al. | |
| D635,370 | S | 4/2011 | Coffaro et al. | |
| D636,608 | S | 4/2011 | Ostendorf et al. | |
| 10,132,042 | B2 * | 11/2018 | Maladen | D21H 27/42 |
| 2004/0028935 | A1 | 2/2004 | Hauke | |
| 2006/0185533 | A1 | 8/2006 | Saueressig | |
| 2007/0137813 | A1 * | 6/2007 | Nickel | B31F 1/07 162/109 |
| 2012/0118519 | A1 * | 5/2012 | Hutchison | D21F 11/006 162/116 |
| 2013/0337243 | A1 | 12/2013 | Ishikawa et al. | |
| 2015/0129146 | A1 | 5/2015 | Chou et al. | |

* cited by examiner

*Primary Examiner* — Mark Halpern

(57) ABSTRACT

Products having improved handfeel and methods for making those products are described. The disclosed napkin product includes an emboss pattern that creates a pillow effect resulting in improved handfeel.

16 Claims, 4 Drawing Sheets

PAPER PRODUCT HAVING AN IMPROVED HANDFEEL

This application is based on U.S. provisional patent application No. 62/421,800, filed Nov. 14, 2016, which is incorporated herein in its entirety.

The present disclosure relates to an absorbent paper product having improved handfeel and to methods for improving the handfeel and softness of a fibrous web. More particularly, the present disclosure relates to a napkin product having an embossing pattern that improves the handfeel of the product. Further, the present disclosure relates to a paper product produced using conventional wet press (CWP) technology that is more economical, while nonetheless, having excellent softness and handfeel.

BACKGROUND

Consumer acceptance of absorbent paper products, such as napkin and towel products, is heavily influenced by the absorbency and the perceived softness of the product. Indeed, the consumer's perception of the desirability of one paper product over another can often rest on the perceived relative softness of the product. Assuming the products have similar absorbency characteristics, napkin and towel products that are perceived to be the puffiness or softest are typically perceived to be more acceptable.

In recent years, many napkin and towel products are produced using through-air-drying (TAD) methods in which a nascent web is dried without compression by passing hot air through the web while it is supported by a fabric. Because it does not suffer from compaction losses, TAD paper sheets currently exhibit the highest caliper, i.e., bulk of any base sheet for use in premium product. However, as compared to conventional wet pressing, TAD is expensive in terms of capital and energy costs.

Despite the proliferation of TAD and similar technologies, CWP products continue to have a place in the commercial market. TAD products enjoy significantly higher bulk than CWP products; however, the added bulk can interfere with a retailer's packaging and sizing choices. To accommodate the added bulk, a package may need to be resized or the product count may need to be reduced to fit in the existing package. Not all customers desire a reduction in product count and/or a larger package size and continue to prefer the less expensive, less bulky/soft CWP product. Given that CWP products are expected to be part of the commercial market indefinitely, manufacturers are consistently looking for ways to improve CWP tissue to bring it closer to the characteristics associated with webs produced via the more expensive TAD.

Manufacturers use a variety of techniques to modify the existing processes for producing commercial CWP products to improve their product attributes to move closer to the perceived absorbency and softness of TAD products. They may improve the fiber used in the fibrous web or they may improve the formation characteristics, for example creping, of the web. However, the majority of product attributes are imparted to an absorbent product during the converting operations that are used to produce the final product.

Product attributes including emboss definition and bulk of the tissue paper are most commonly found to affect the perceived softness of the absorbent product. A typical commercial napkin embossing process involves the compression and stretching of the flat tissue base sheet between two hard rolls each of which contain both male and female elements. The male elements of one emboss roll are engaged or mated with the female elements of another mirror image emboss roll. This method of embossing impacts the aesthetics of the tissue as well as the properties of the tissue sheet. It is well understood that embossing generally improves the bulk of the tissue web.

While embossing improves bulk, many emboss processes do not improve the handfeel and softness of the product. They may improve the perceived softness of a product, by making it appear puffier or more quilted. The emboss pattern as described in the instant disclosure improves the physical handfeel of the product in a manner not available in prior art emboss processes.

The present disclosure describes an embossed paper product having improved handfeel. According to one embodiment, the paper product has improved handfeel without a significant increase in caliper and/or bulk. The present disclosure also describes an embossing method that deforms the paper web in a new way to create pillows that provide significantly improved handfell from a CWP base sheet.

SUMMARY OF THE DISCLOSURE

The present disclosure relates to a soft tissue product produced with an emboss pattern described in the instant disclosure. The present disclosure further relates to a method of applying the embossing pattern to a CWP base sheet to achieve superior handfeel at considerable energy savings.

In one embodiment, the present disclosure relates to a napkin product comprising a base sheet comprising an emboss pattern that is across at least about 50% of the napkin product, wherein the emboss pattern comprises a series of emboss elements comprising petal-elements; wherein two petal elements from adjacent emboss elements together form one side of a pillow zone; wherein the pair of petal elements forming the side of the pillow zone are separated by a distance between the elements from about 0.005 inches to about 0.050 inches; and wherein the ratio between the length of the side of the pillow zone, measured from the center of the emboss elements, is from about 2:1 to about 60:1.

An emboss pattern for improving the softness of a tissue sheet comprising, at least about 20 emboss elements per $in^2$, wherein each emboss element comprises four petal-elements that are set at a 90° angle to one another; and wherein the pattern of elements is offset from the machine direction.

A method of making a single-ply napkin comprising, embossing a base sheet with an emboss pattern; wherein the emboss pattern comprises a series of repetitive emboss elements and each repetitive emboss element comprising petal-elements; wherein two petal elements from adjacent emboss elements together form one side of a pillow zone; and folding the base sheet into quarters to form a napkin product.

A napkin product comprising, a base sheet having a basis weight of at least about 17.5 lbs/3000 $ft^2$, wherein the base sheet is embossed with a pattern comprising at least about 20 elements per $in^2$; wherein each element comprises four petal-elements; wherein each petal-element comprises a petal emboss; and wherein the base sheet is folded in half or into quarters to form the napkin product.

Additional advantages of the described methods and products will be set forth in part in the description which follows, and in part will be obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed. The accompanying drawings, which are incorporated in and constitute a part of this specification, illustrate several embodiments and together with the description, serve to explain the principles of the disclosure.

DESCRIPTION

Figure 1:
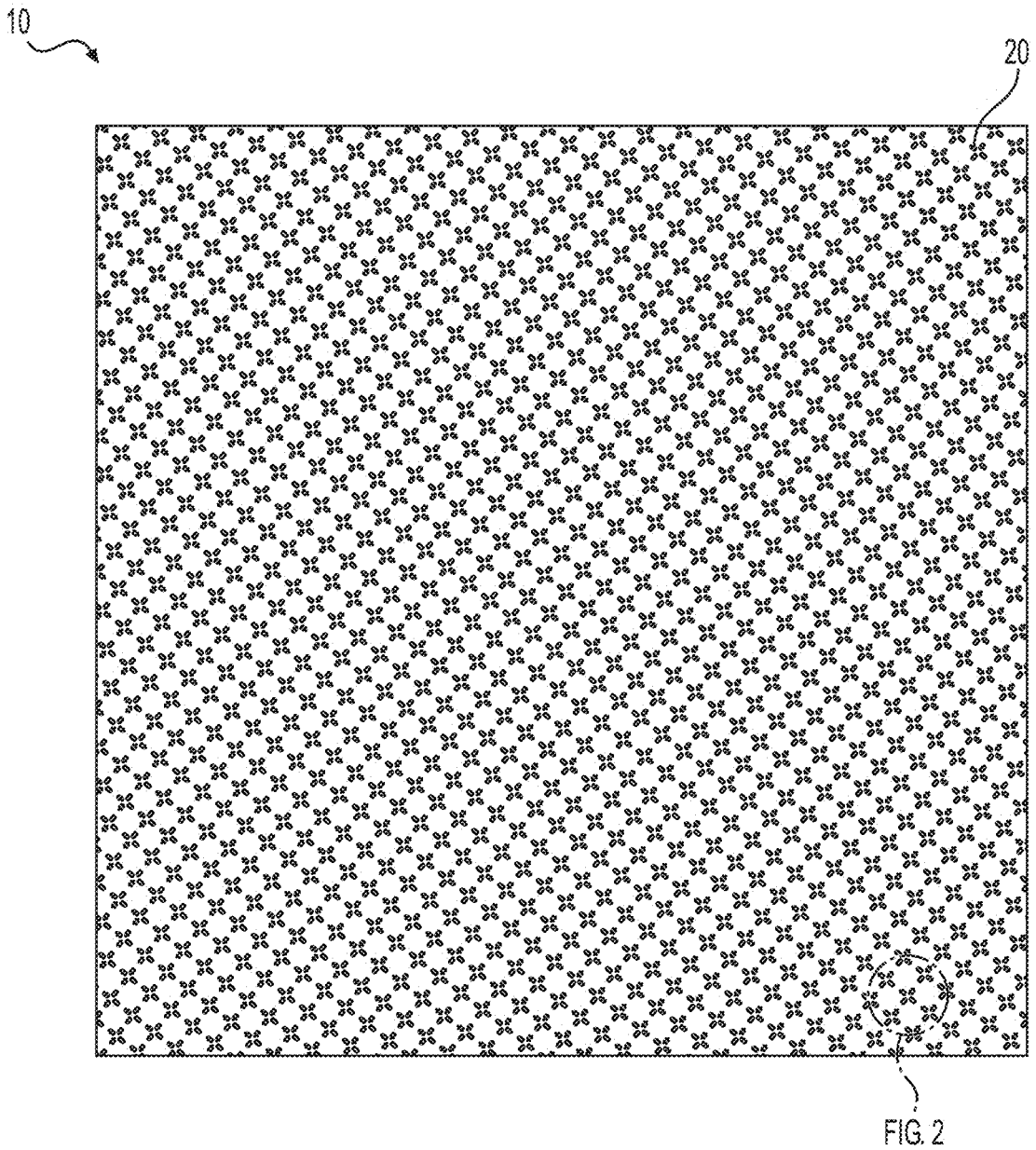
FIG. 1 illustrates an emboss pattern for use on one product according to the disclosure.

Reference will now be made in detail to certain exemplary embodiments, examples of which are illustrated in the accompanying drawings. Wherever possible, the same reference numbers will be used throughout the drawings to refer to the same or like items.

The product as described herein, is a paper product, for example, a napkin product that has an improved handfeel. The handfeel is the result of an embossing structure that forms raised areas between emboss elements, those raised areas forming pillow-elements that are braced-up by the emboss elements. Those pillows contact the skin of the user and are felt more prominently than the surrounding embosses and deliver a softer more luxurious handfeel to the product.

While the method will be described with respect to the production of a napkin product, it can be used to produce single or multi-ply products including toilet tissue, paper towels, facial tissue, wipers, and other consumer tissue products desiring an aesthetic look and improved handfeel. The embossing method as disclosed can be applied to any non-woven product, natural or synthetic, where improved handfeel is desired.

In a CWP process, a furnish of pulp, water, and other chemicals, is fed to a headbox from which it is deposited on a forming wire. The nascent web is transferred to a papermaking felt and is dewatered by passing it between the felt and a press roll under pressure. The web is then pressed by a suction press roll against the surface of a rotating Yankee dryer cylinder that is heated to cause the paper to substantially dry on the cylinder surface. The moisture within the web as it is laid on the Yankee surface causes the web to transfer to the surface. Liquid adhesive may be applied to the surface of the dryer, as necessary, to provide substantial adherence of the web to the surface. The web is then removed from the Yankee surface with a creping blade. The creped web is then passed between calender rollers and rolled up to be used as a base sheet in the downstream production of a tissue product. This method of making tissue sheets is commonly referred to as "wet-pressed" because of the compactive method used to dewater the wet web.

As used in the present disclosure "wet press," "wet-pressed," "wet-pressing," "conventional wet press," "CWP" and other variations on those phrases refer to processes by which a base sheet can be produced. These processes all share the characteristic that the sheet is dewatered under pressure. While one CWP operation is described above, the system is only exemplary and variations on the described system will be readily apparent to the skilled artisan.

As used herein "web," "sheet," "tissue," "nascent web," "tissue product," "base sheet" or "tissue sheet," can be used interchangeably to refer to the fibrous web during various stages of its development. Nascent web, for example, refers to the embryonic web that is deposited on the forming wire. Once the web achieves about 30% solids content, it is referred to as a tissue, or a sheet or a web. Post production, the single-ply of tissue is called a tissue sheet, or more correctly a base sheet. The base sheet may be combined with other base sheets to form a tissue product or a multi-ply product.

More particularly, the base sheet for use in the products of the present disclosure may be made from any art recognized fibers. Papermaking fibers used to form the absorbent products of the present disclosure include cellulosic fibers, commonly referred to as wood fibers. Specifically, the base sheet of the disclosure can be produced from hardwood (angiosperms or deciduous trees) or softwood (gymnosperms or coniferous trees) fibers, and any combination thereof. Hardwood fibers include, but are not limited to maple, birch, aspen and eucalyptus. Hardwood fibers generally have a fiber length of about 2.0 mm or less. Softwood fiber includes spruce and pine and exhibits an average fiber length of about 2.5 mm. Cellulosic fibers from diverse material origins may also be used to form the web of the present disclosure. The web of the present disclosure may also include recycle or secondary fiber. The products of the present disclosure can also include synthetic fibers as desired for the end product.

Papermaking fibers can be liberated from their source material by any one of the number of chemical pulping processes familiar to one experienced in the art including sulfate, sulfite, polysulfite, soda pulping, etc. The pulp can be bleached as desired by chemical means including the use of chlorine, chlorine dioxide, oxygen, etc. Alternatively, the papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching.

The fiber is fed into a headbox where it will be admixed with water and chemical additives, as appropriate, before being deposited on the forming wire. The chemical additives for use in the formation of the base sheets can be any known combination of papermaking chemicals. Such chemistry is readily understood by the skilled artisan and its selection will depend upon the type of end product that one is making. Papermaking chemical include, for example, strength adjusting agents, softeners and debonders, creping modifiers, sizing agents, optical brightening agents, retention agents, and the like. The method used in the instant invention to improve handfeel should not generally be affected by the chemistry of the base sheet.

A first nascent web is formed from the pulp. The web can be formed using any of the standard wet-press configurations known to the skilled artisan, e.g., crescent former, suction breast roll, twin-wire former, etc. Once the web is formed, it may have a basis weight, under TAPPI LAB CONDITIONS of at least about 14 lbs/3000 sq. ft. ream, for example, at least about 15 lbs/3000 sq. ft. ream, for example, at least about 16-20 lbs/3000 sq. ft. ream, for example, at least about 17.5 lbs/3000 sq. ft. ream, for example at least about 18-20 lbs/3000 sq. ft. ream, for example, at least about 19 lbs/3000 sq. ft. ream. TAPPI LAB-CONDITIONS refers to TAPPI T-402 test methods specifying time, temperature and humidity conditions for a sequence of conditioning steps. While these basis weights are specific to a single-ply napkin product, the skilled artisan could adjust the basis weight depending upon the desired end product and the number of plies it will have.

The web is transferred from the forming wire to a felt or fabric for compactive dewatering. Finally, the web is adhered to a Yankee dryer. The web can be adhered to the Yankee dryer using any known creping adhesive.

The web is then creped from the Yankee dryer. The relative speeds between the Yankee dryer and the reel are preferably controlled to such a level that a reel crepe of at least about 20%, more preferably 24% and most preferably 25% is maintained. Percent crepe is defined as the Yankee dryer speed minus the reel speed, divided by the Yankee dryer speed, expressed as a percentage. Creping is preferably carried out at a pocket angle of from about 50° to about 100°, for example, 70° to about 92°, preferably about 73° to about 90° and more preferably about 80°.

The web is then calendered and rolled to await converting. Converting refers to the processes that change or convert a base sheet into a final product. Typical converting in the area of tissue and towel can include embossing, folding, perforating, plying, and the like.

While exemplary formation of the base sheet is detailed above, products using any base sheet can benefit from the improved handfeel associated with the disclosed invention. The base sheet for use in the present disclosure is preferably made via CWP, but it could be made via TAD or other structured tissue formation methods and can include base sheets that are creped or uncreped, homogeneous or stratified, wet-laid or air-laid and may contain up to 100% non-cellulose fibers.

As described herein, the improved paper product is produced by passing the base sheet between embossing rolls comprising a pattern that delivers the characteristics as shown and described herein. A typical commercial napkin embossing process involves the compression and stretching of the flat tissue base sheet between two hard rolls each of which contain both male and female elements. The male elements of one emboss roll are engaged or mated with the female elements of another mirror image emboss roll. These emboss rolls can be made of materials such as steel or hard rubber. In this process, the base sheet is only compressed between the sidewalls of the male and female elements. Therefore, base sheet thickness is better preserved and bulk perception of a product can be improved. This mated process and pattern may also create a softer tissue because the top of the tissue protrusions remain soft and uncompressed. As an alternative to the rigid-rigid embossing technique, the base sheets can also be embossed between a relatively soft rubber roll or a fiber roll and a hard roll which bears a pattern of emboss elements in what is commonly referred to as a "rigid-resilient. According to one embodiment, the base sheets of the present disclosure can be embossed in a rigid-resilient fashion. According to one embodiment, if the pattern is applied to a towel or light tissue product, a rigid-resilient configuration may be used.

The emboss pattern as seen in FIG. 1 is one example of a pattern that can be used to create the product as described herein. Not wishing to be bound by theory, it is believed that a series of emboss elements can create raised pillows that are braced up above the embossments making them puffy areas that are the primary contact for the skin. After being raised, the pillows remain stable making the product feel markedly softer than prior art product.

FIG. 1 depicts a repeating pattern 10 for use in the products of the present disclosure. According to the illustrated embodiment, the pattern 10 comprises a series of embossing elements 20. As can be seen in FIG. 1, the emboss pattern of this embodiment is offset from the machine direction. According to the embodiment shown, the embossing elements 20 are repetitive and are arranged in a symmetrical and iterated pattern. The repetitive embossing elements 20 are seen enlarged in FIG. 2.

As used herein "symmetrical" refers to the regularness of the pattern and the distance between the individual emboss elements as being the same or substantially the same. Symmetrical does not require that all spacing is equidistant, however, according to one embodiment the emboss elements are equidistant from one another.

As used herein "iterated" means a repetition of emboss elements. By way of example, one emboss element next to another, next to another, would be an iterated pattern. According to one embodiment, the iterated pattern is composed of a series of emboss elements. Iterated does not require that the entire product be covered.

According to one embodiment, the iterated pattern is repetitive, i.e., the elements would not be separated from the surrounding elements by any other types of emboss elements or unembossed space. When emboss elements are referred to herein as "repetitive", the same element or series of elements that form the pillow zone 50 is duplicated at all of the adjacent positions. According to one embodiment, for a commercial product, the pattern 10 may also be continuous, i.e., traverse the entire width and length of the base sheet.

As used herein adjacent refers to the relationship between elements and refers to one element that appears immediately proximate another element. For example, adjacent emboss elements may be the same or different. According to one embodiment, adjacent emboss elements are the same. According to another embodiment, an emboss element having a different petal configuration, or petal length, or spacing may be adjacent an embossing elements as shown, for example, in FIG. 1.

Figure 2:
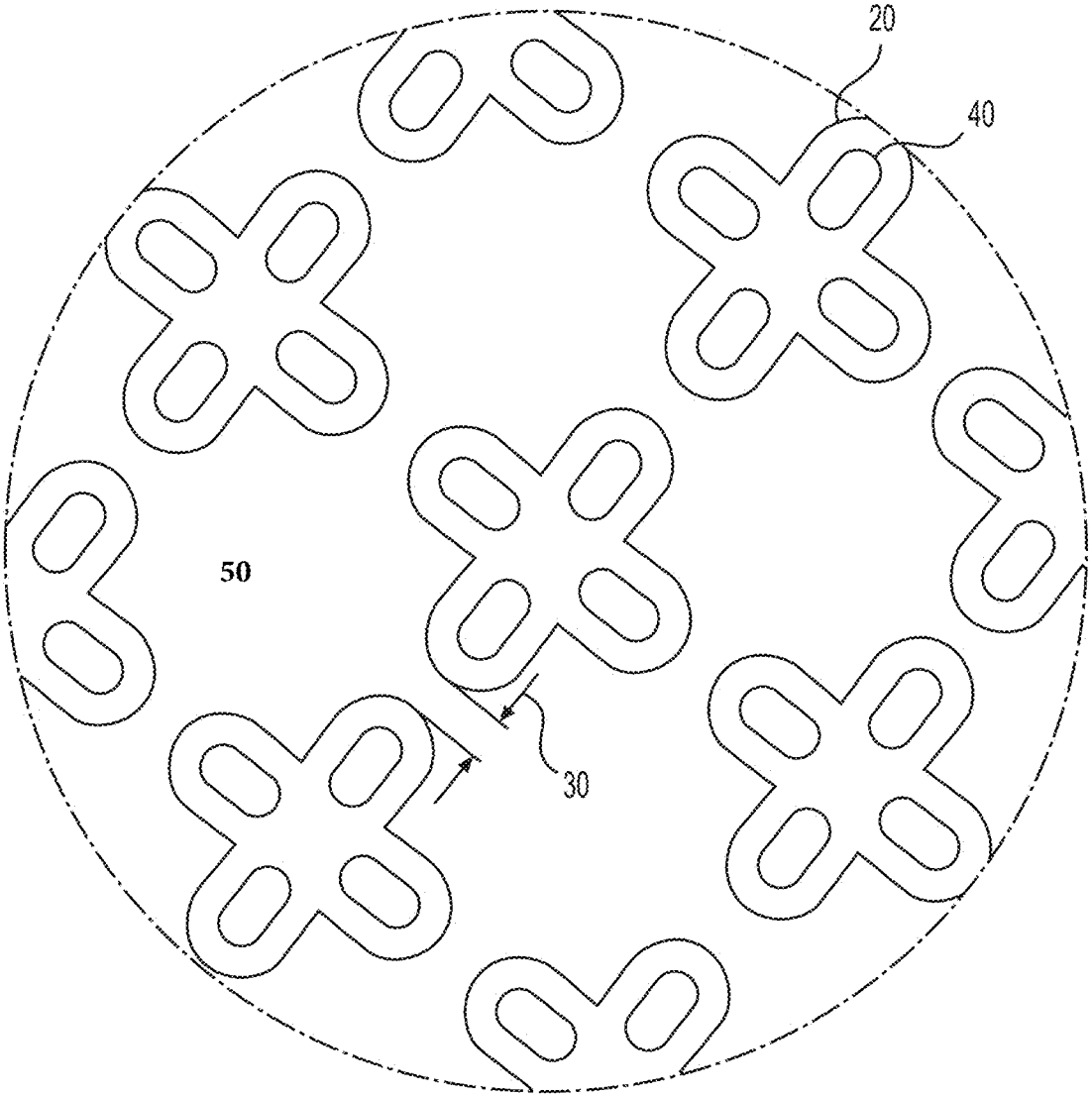
FIG. 2 illustrates an expanded view of emboss elements of the pattern illustrated in FIG. 1.

According to the embodiment as shown in FIGS. 1 and 2, the iterated emboss elements 20 include four petal-elements. According to the illustrated embodiment, the petal-elements are of equal size. When measure the petal-element size, the measurement if made from the center of the emboss element 20. According to another embodiment, the petal-elements can be of unequal size, for example, two of the petal elements may be longer than the other two petal elements. According to another embodiment, the iterated emboss element may have more or less than four petal-elements, for example, three petal-elements, five petal-elements or six petal-elements.

As can be seen in FIG. 2, the end of a petal-element on a first emboss element 20 is proximate the end of a petal-element on an adjacent emboss element 20 separated by a distance 30. In the embodiment shown, this set of two petal-elements together define one size of a pillow zone 50. In the embodiment illustrated, the set of petal elements that define the pillow zone 50 are each located on one of four adjacent iterated emboss elements 20. The number of petal-elements in the set that defines the sides of the pillow zone 50 may equal the number of petal-elements on an individual iterated emboss element 20. The set of petal-elements together cause the pillow zone 50 to raise up slightly and remain stable, thereby acting as a puffy and soft area giving the paper product exceptional handfeel.

In one embodiment as seen in FIG. 2, to improve the definition of the petal-elements, the petal-elements further include a petal emboss 40 on the petal-element(s) of the iterated emboss element 20. The petal embosses are raised areas of the paper that have been embossed to be above the plane of the petal elements 40. The petal embosses may take any shape and/or size and can provide improved definition to the embossing elements 20 and/or to the individual petal-elements. According to one embodiment, each petal-elements will have a petal emboss. According to another embodiment, the petal-elements will not have a petal emboss. According to yet another embodiment, some, but not all of the petal-elements will have a petal emboss.

As used herein, emboss element refers to the entire structure 20, petal-element refers to the projections on the structure 20, and petal-emboss refers to the raised areas located on the projections of structure 20.

Figure 3:
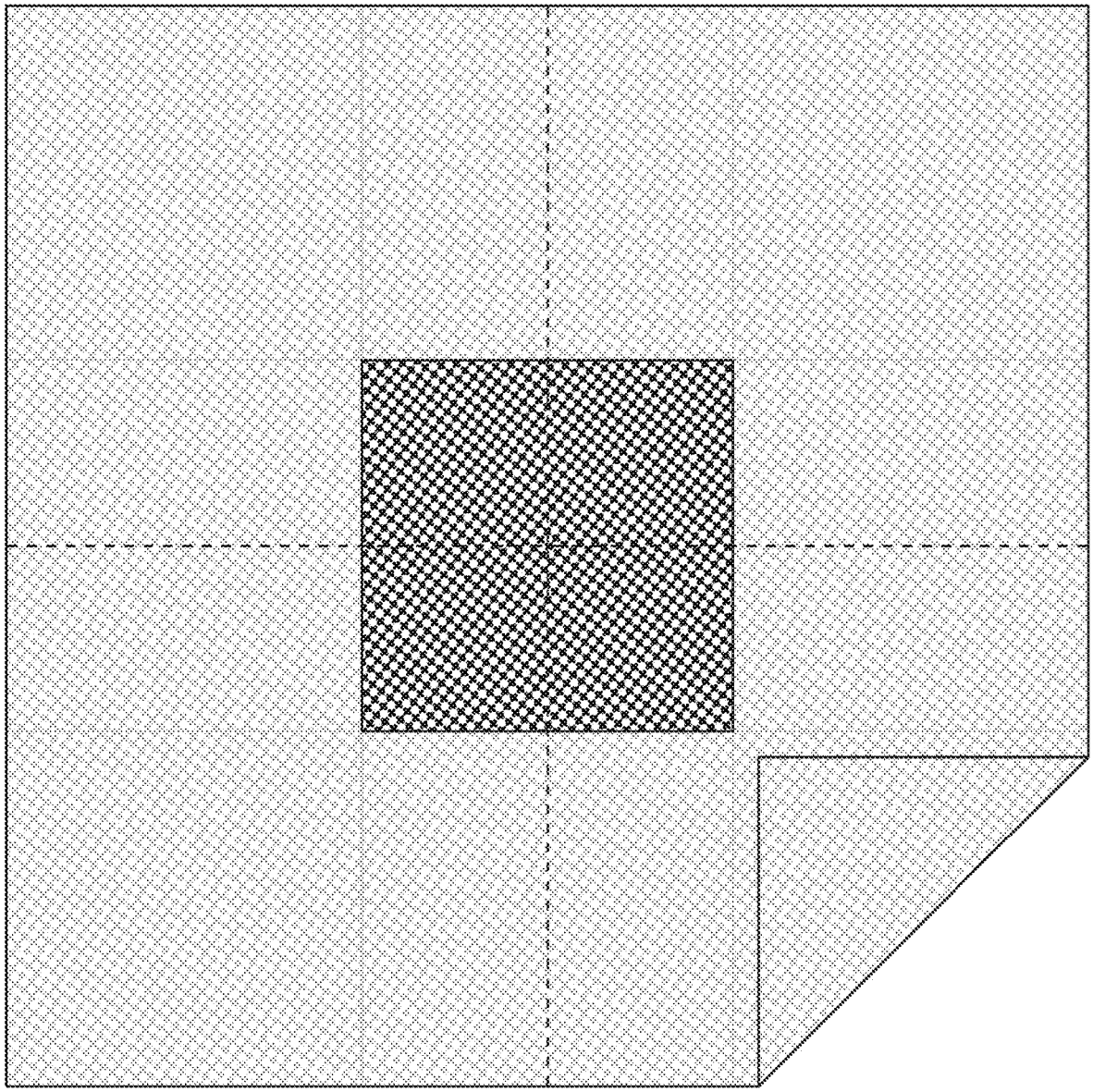
FIG. 3 illustrates the repeat unit of the emboss pattern of FIG. 1 on a napkin product.

The emboss pattern 10 of the illustrated embodiment provides an iterated series of elements that creates an iterated series of pillows such that each pillow zone 50 is surrounded on all sides by other pillow zones. This embodiment includes no areas which are free of iterated emboss elements. FIG. 3 illustrates a quarter fold napkin product that includes iterated emboss elements over 100% of its surface. In the center of FIG. 3 is a single repeat unit of the emboss pattern 10, shown in full color. Surrounding the single repeat unit, additional repeat units are illustrated in grayscale. The intersecting dotted lines exemplify fold lines.

The napkin product according to the present disclosure can be a half-fold, quarter-fold, or one-eighth-fold napkin product.

According to one embodiment, the napkin product in its completed form may be entirely covered by the embossing pattern or may include some amount of the surface that is free from the emboss pattern. For example, if the napkin were to have a coin edge, the iterated pattern may be used only in the center of the napkin, not along the edge. According to such embodiments, the emboss pattern will nonetheless cover or be across at least about 50% of the surface area of the paper product, for example, at least about 60% of the surface area of the paper product, for example, at least about 70% of the surface area of the paper product, for example, at least about 80% of the surface area of the paper product, for example, at least about 90% of the surface area of the paper product to achieve the improved handfeel associated with the pattern as described. As used herein, the "surface area of the emboss pattern" refers to the macro area of the product that the pattern crosses, for example, the emboss pattern may cover or be across half the product. This surface area is different and apart from the surface area of the emboss elements.

Surface area is traditionally understood to be an attribute of the emboss pattern referring to the micro area of the product that is actually compressed by the individual emboss elements. As used herein, "the surface area of the emboss elements" will be used to distinguish this actual contact area of the embossments from the amount of the surface that is covered by the pattern discussed above. According to one embodiment, the surface area of the emboss elements (area compressed by the contact surface of the embossing elements) is from about 8% to about 15%, for example, from about 10% to about 15%, for example, from about 10% to 12%.

According to one embodiment, the embossing elements are as shown in FIG. 2, and the length of the side of the pillow zone, measured from the center of each emboss element 20, is from between about 0.0900 inches and about 0.300 inches, for example, between about 0.100 inches and about 0.250 inches for example, between about 0.120 inches and about 0.200 inches for example, between about 0.120 inches and about 0.180 inches.

According to one embodiment, the repetitive embossing elements are separated by a distance of from about 0.005 to about 0.050, for example, from about 0.010 to about 0.040, for example, from about 0.020 to about 0.030.

According to one embodiment, the elements are spaced apart from one another. The ratio between the length of the side of the pillow zones 50 and the distance between the petal elements may be from about 2:1 to about 60:1, for example, from about 5:1 to about 40:1, for example, from about 5:1 to about 20:1, for example, from about 7:1 to about 10:1.

According to illustrated embodiment, the repetitive embossing elements have an aspect ratio of about 1. According to another embodiment, the repetitive emboss elements can have an aspect ratio of from about 0.5 to about 2.0.

According to another embodiment, the angle of the sidewalls of the repetitive elements is between about 10 and about 30 degrees, for example, between about 19 and 23 degrees, for example, about 20 degrees. According to yet another embodiment, the repetitive embossing elements are embossed to a depth of from 0.050 to about 0.080 inches, for example, to a depth of about 0.045 to about 0.06 inches, for example, from about 0.045 to about 0.05.

According to one embodiment, the average density of the repetitive embossing elements is from about 20 to 35 emboss elements/sq. in, for example, from 20 to about 32 emboss elements/sq. in, for example, from about 20 to about 30 embossments/sq. in.

While the invention has been described with respect to a series of emboss elements with petals, other emboss patterns may be used to create the same effect. According to this embodiment, the emboss elements should create pillow zoness that are bounded by a series of sides. The sides of the pillow zone are not solid lines but are discontinuous and have a break in the middle. The break in the side defining the pillow zone is believed to release tension and assist in stabilizing the pillow. Finally, according to this embodiment, the sides of one pillow zone are also sides of an adjacent pillow zone.

While the foregoing description has been directed to a napkin product, if the embossing pattern 10 is applied to another paper product, the selection of an appropriate base sheet, number of plies and correct converting operations would be well within the skill of the average artisan in the papermaking field.

The product of the present disclosure has a caliper of from at least about 85 to about 105, for example from about 87 to about 100 mils/8 sheets, for example, from about 89 to about 95 mils/8 sheets, for example from about 90 to 92 mils/8 sheets.

Calipers reported herein are 8-sheet calipers unless otherwise indicated. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For base sheet testing off of the paper machine reel, single plies are used with eight sheets being selected and stacked together. Specific volume is determined from basis weight and caliper.

The product of the present disclosure has a CD dry tensile strength of from about 450 to about 750 g/3 in., for example, about 500 to about 700 g/3 in., for example, about 550 to about 675 g/3 in.

The product of the present disclosure has a MD dry tensile strength of from about 800 to about 1400 g/3 in., for example, about 850 to about 1350 g/3 in., for example, about 1050 to about 1200 g/3 in.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4° F.), with the tensile test run at a crosshead speed of 2 in/min for modulus, 10 in/min for tensile. For purposes of calculating modulus values, three inch wide specimens were pulled at 0.5 inches per minute so that a larger number of data points were available. Unless otherwise clear from the context, stretch refers to stretch (elongation) at break. Break modulus is the ratio of peak load to stretch at peak load. Tensile modulus, reported in grams per inch per percent strain, is determined by the same procedure used for tensile strength except that the modulus recorded is the geometric mean of the chord slopes of the cross direction and machine direction load-strain curves from a value of 0 to 100 grams, and a sample width of only one inch is used.

The product of the present disclosure has a CD Finch Wet Tensile strength of from about 110 to about 180 g/3 in., for example, about 120 to about 150 g/3 in., for example, about 140 to about 150 g/3 in. The values were measured according to TAPPI T456 using a Finch cup for testing.

The product of the present disclosure has a GM Break Modulus of from about 60 to about 110, for example, from about 70 to about 110, for example from about 70 to about 100, for example, from about 70 to about 90. GM break modulus is calculated as an average of the peak load over the stretch at peak load. The measurement of peak load and stretch are described above.

The product of the present disclosure has a bulk of at least about 4.5 (caliper/BW)/mils/8plies/lb/ream, for example, from about 4.8 to about 5.4 (caliper/BW)/mils/8plies/lb/ream, for example, from about 4.8 to about 5.2 (caliper/BW)/mils/8plies/lb/ream. Bulk is calculated from the caliper and basis weight measurements as described above.

Figure 4:
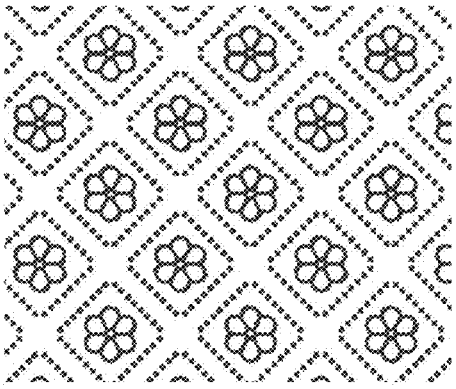
FIG. 4 illustrates the comparative six petal emboss pattern of the commercial napkin product.

The emboss pattern 10 provides a napkin product having superior properties and, especially, handfeel. In side by side testing with the prior commercial product as shown in FIG. 4, the product as described herein was significantly softer than the prior art product to a 95% confidence level. The emboss pattern 10 as described herein surprisingly resulted in a series of stabilized pillow zones 50 that modified the handfeel of the product, making if feel softer, without a substantial change to the caliper or bulk of the product.

It should be noted that the methods and products described herein should not be limited to the examples provided. Rather, the examples are only representative in nature.

Example 1

Two napkin products were produced using base sheets made at the same commercial paper mill. The first product, the comparative product, was embossed with the embossing pattern used on the current commercial napkin product, repetitive pattern of a six petal flowers in boxes, as seen in FIG. 4. The second product was embossed with the emboss pattern 10 as seen FIG. 1. These products, along with a commercial napkin product having the same pattern as the comparative product, were tested and the results are set forth in Table 1, below.

As can be seen from Table 1, below, products according to the present invention exhibited properties in line with the prior art product, but upon contact, the products were significantly softer than the comparative product.

TABLE 1

| | Measured Items | | |
|---|---|---|---|
| | Commercial Napkin Past 6 month Production Average | Napkin Control produced from the same base sheet as the inventive product but with the comparative emboss pattern of FIG. 4 | Inventive Napkin product |
| | Emboss Pattern | | |
| | FIG. 4 Emboss | FIG. 4 Emboss | Inventive FIG. 1 Emboss |
| Caliper (mils/8 sheets) | 96 | 96 | 90 |
| Basis Weight (lb/3000 $ft^2$) | 18.8 | 19.5 | 18.7 |
| CD Finch Wet tensile (gms/3") | 149 | 141 | 147 |
| CD dry Tensile (gms/3") | 671 | 738 | 628 |
| MD dry Tensile (gms/3") | 1039 | 1279 | 1338 |
| GM Break Modulus | 69 | 92 | 104 |
| Package/Sleeve Length ((inches) | 15.00 | 15.00 | 15.00 |
| Packages or Sleeves/Co-Pack bag/Case | 4 | 4 | 4 |
| Sheet Count per sleeve or package | 300 | 300 | 300 |

As can be seen from Table 1, the napkin product with the emboss pattern as disclosed is generally comparable in all aspects to the commercial napkin product. So without a loss of strength or an increase in caliper or bulk, one of which is routinely needed to improve product softness, the emboss pattern and process for embossing the napkin product as disclosed herein provided unexpected improved product softness.

Example 2

Commercial napkin products were produced using the emboss pattern as seen in FIGS. 1-2. The comparative product, was embossed with the six petal flower embossing pattern used on the current commercial napkin product as seen in FIG. 4. As seen in Table 2 below, the inventive product maintained substantially the same physical characteristics while attaining significant softness improvements.

| Critical Physical Property | FIG. 4 emboss pattern | | FIG. 1 emboss pattern | | | | |
|---|---|---|---|---|---|---|---|
| | LSL | USL | Lane 1 | Lane 2 | Lane 3 | Lane 4 | Average |
| Stack Height in inches | 14.75 | 15.25 | 14.9 | 14.9 | 15.0 | 14.9 | 14.9 |
| Basis Wt. (lb./rm) | 18.0 | 20.0 | 18.39 | 18.34 | 18.55 | 18.43 | 18.43 |
| Caliper (mils/8 sheet) | 85 | 105 | 90.6 | 90.2 | 90.5 | 91.5 | 91.0 |
| MD Dry Tensile (g/3") | 770 | 1430 | 849 | 1063 | 1169 | 1031 | 1028 |
| CD Dry Tensile (g/3") | 450 | 850 | 567 | 676 | 665 | 466 | 594 |
| CD Finch Wet tensile (g/3") | 105 | 195 | 128 | 167 | 166 | 116 | 144 |
| GM Break Modulus (g/% stretch) | 55 | 105 | — | — | — | — | |

In a direct comparison between the comparative product and the inventive product, the inventive product was considered significantly softer at a 95% confidence level.

Subjective product attributes, such as softness, were evaluated using test protocols in which a consumer uses and evaluates the product. The softness evaluations were paired comparison tests, in which a panel of trained consumers were given samples of two different products and asked to rate each vis-à-vis the other for either specific attributes or overall preference. Softness is a subjectively measured tactile property that approximates consumer perception of sheet softness in normal use. Softness was compared by 37 trained panelists and included internal comparison among product samples. The results obtained were that the product as described and claimed was substantially softer than the comparative product to a statistically significant confidence level of 95%.

Other embodiments will be apparent from consideration of the specification and practice of the present disclosure. It is intended that the specification and examples be considered as exemplary only, with a true scope and spirit of the invention being indicated by the following claims.

What is claimed is:

1. A napkin product comprising:

a base sheet produced by conventional wet pressing comprising an emboss pattern that is across at least about 50% of the napkin product;

wherein the emboss pattern comprises a series of emboss elements comprising petal-elements;

wherein two petal elements from adjacent emboss elements together form one side of a pillow zone;

wherein the pair of petal elements forming the side of the pillow zone are separated by a distance from about 0.005 inches to about 0.050 inches;

wherein the ratio between the length of the side of the pillow zone, measured from the center of the emboss elements, and the separation distance between the adjacent petal elements is from about 2:1 to about 60:1; and wherein the embossed base sheet has a caliper of from at least about 85 to about 105 mils/8 sheets.

2. The napkin product of claim 1, wherein the ratio between the length of the side of the pillow zone and the distance between the adjacent petal elements is from about 5:1 to about 10:1.

3. The napkin product of claim 1, wherein each emboss element comprises four petal-elements.

4. The napkin product of claim 3, wherein the four petal-elements are set at a 90° angle to one another.

5. The napkin product of claim 3, wherein the emboss pattern comprises at least about 20 emboss elements per square inch.

6. The napkin product of claim 1, wherein the emboss pattern is symmetrical.

7. The napkin product of claim 1, wherein the emboss pattern is iterated.

8. The napkin product of claim 1, wherein the emboss pattern is continuous.

9. The napkin product of claim 1, wherein the emboss pattern is repetitive.

10. The napkin product of claim 1, wherein at least one petal-element comprises a petal emboss.

11. The napkin product of claim 1, wherein the basis weight is at least about 17.5 lbs/300 sq. ft.

12. The napkin product of claim 1, wherein the base sheet is folded in half to form the napkin product.

13. The napkin product of claim 1, wherein the base sheet is folded in quarters to form the napkin product.

14. The napkin product of claim 1, wherein the wet tensile is at least about 145 gms/3".

15. A napkin product comprising:

a base sheet produced by conventional wet pressing having a basis weight of at least about 17.5 lbs/3000 $ft^2$;

wherein the base sheet is embossed with a pattern comprising at least about 20 elements per $in^2$, wherein each element comprises four petal-elements;

wherein each petal-element comprises a petal emboss that forms a pillow zone;

wherein the embossed base sheet has a caliper of from about 85 to about 105 mils/8 sheets; and wherein the base sheet is folded in half or into quarters to form the napkin product.

16. A napkin product comprising:

a base sheet produced by conventional wet pressing comprising an emboss pattern;

wherein the emboss pattern comprises a series of emboss elements forming a pillow zone;

wherein the emboss elements that form one side of the pillow zone also form one side of the adjacent pillow zone;

wherein the emboss elements that form the side of the pillow zone comprise an interruption of from about 0.005 inches to about 0.050 inches that remains unembossed space; and wherein the embossed base sheet has a caliper of from about 85 to about 105 mils/8 sheets.

* * * * *